313-422 SR
1/30/79 OR 4,137,478

United States Patent [19] [11] 4,137,478
Credelle [45] Jan. 30, 1979

[54] COLOR FLAT PANEL TELEVISION

[75] Inventor: Thomas L. Credelle, East Windsor, N.J.

[73] Assignee: RCA Corporation, New York, N.Y.

[21] Appl. No.: 808,294

[22] Filed: Jun. 20, 1977

[51] Int. Cl.[2] ..... H01J 29/72; H01J 29/80
[52] U.S. Cl. ..... 313/422
[58] Field of Search ..... 313/422, 470

[56] References Cited

U.S. PATENT DOCUMENTS

| | | | |
|---|---|---|---|
| 2,692,532 | 10/1954 | Lawrence | 358/71 C |
| 2,860,271 | 11/1958 | Sandor | 358/71 X |
| 4,031,427 | 6/1977 | Stanley | 313/422 |
| 4,069,439 | 1/1978 | Anderson | 313/422 |

*Primary Examiner*—Robert Segal
*Attorney, Agent, or Firm*—E. M. Whitacre; G. H. Bruestle; G. E. Haas

[57] ABSTRACT

An evacuated envelope includes front and rear walls in spaced parallel relationship to one another and connected by a plurality of side walls. On the inner surface of the front wall is a cathodoluminescent screen having stripes of different color light emitting phosphor material. Within the envelope and adjacent to the back wall are a plurality of electron beam guides extending in one dimension. The electron beam guides include means for deflecting the beam out of the guide toward the screen. Between the screen and the beam guides in the evacuated envelope is means for focusing the deflected electron beam sequentially onto one of several stripes of the screen.

10 Claims, 3 Drawing Figures

COLOR FLAT PANEL TELEVISION

BACKGROUND OF THE INVENTION

The present invention relates to flat panel display devices and methods of operating them and particularly to such display devices for displaying a color image.

Recently, a flat panel image display device has been developed having an envelope with front and rear walls in spaced parallel relationship separated by four sidewalls. Within the envelope and extending between the front and rear walls are a plurality of support vanes dividing the interior into a number of channels. On the interior of the front wall is a cathodoluminescent screen composed of a series of phosphor stripes. Within each channel is at least one electron beam guide for directing an electron beam down the channel from one end. The electron beam guides include means for deflecting the electron beam out of the guide at various points along the guide towards the cathodoluminescent screen. As in conventional display devices, a single frame of the image is composed of two interlaced fields. Each deflection point along the guides defines a line in one dimension, e.g., horizontal, in each field of the image to be displayed. One version of this display device known as an element scale tube uses a separate guide and beam for each color element in the line. To achieve field interlace in the newly developed display device, the beams may be alternately extracted from the guides at odd deflection points to form one field and then from the even points to form the other field of the frame. Alternately, each deflection point is used for two adjacent lines of the display image. During one field of the frame, the beams are deflected out of each point along the beam guides to the set of odd interlaced lines on the screen and during the second field of the frame and the beams at each deflection point are directed to the set of even screen lines. This deflection technique is described more fully in copending U.S. patent application Ser. No. 749,412 entitled "Flat Panel Display and Method of Operating the Same" filed on Dec. 10, 1976 by T. Credelle. In these devices, a separate beam guide and beam are utilized for each color element of the display and phosphor stripes extend longitudinally parallel to the beam guides.

Different approaches for color selection have been taken in other types of flat panel displays. One scheme is shown in U.S. Pat. No. 2,879,446 issued on Mar. 24, 1959 to W. R. Aiken in which an array of wires parallel to the screen serves as a form of shadow mask. By deflecting the electron beam toward the screen and between one pair of adjacent wires at different angles, a particular phosphor strip is excited. The Aiken device does not employ electron beam guides parallel to the screen as in the previously described prior art devices.

SUMMARY OF THE INVENTION

A flat panel image display device includes an envelope having a front and rear wall in a spaced parallel relationship. On the interior surface of the front wall is a cathodoluminescent screen comprised of a plurality of different colored light emitting phosphor stripes. Within the envelope are a plurality of electron beam guides including means for deflecting electron beams out of the guides toward the screen at varioius points along the guide's lengths so that one beam can excite different color light emitting phosphor regions. Also contained within the envelope between the guides and the screen is an array of focus wires, there being at least as many wires in the array as there are phosphor stripes.

DETAILED DESCRIPTION OF THE PREFERRED EMBODIMENTS

Figure 1:
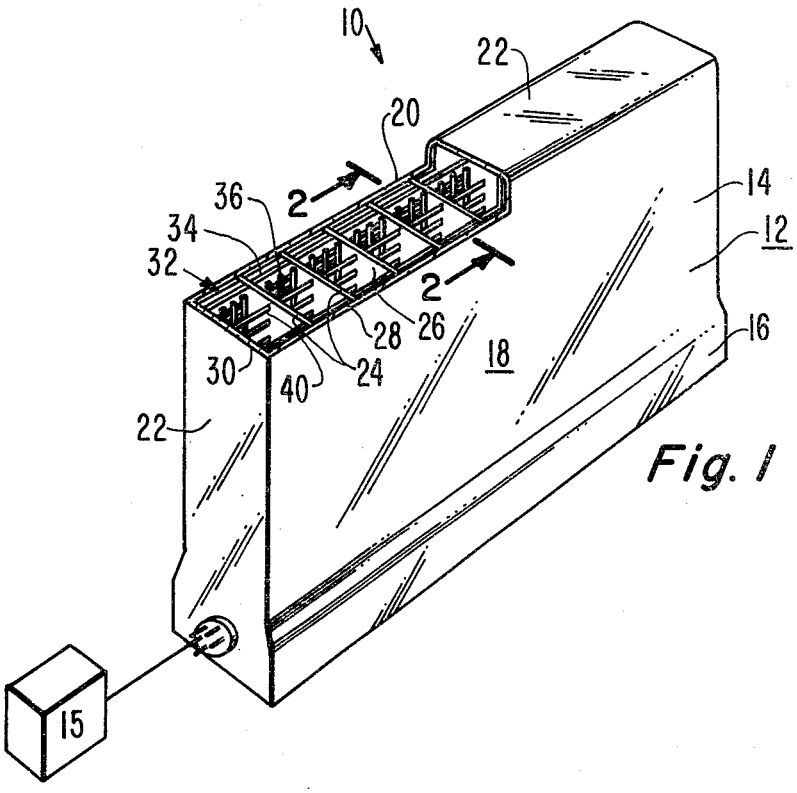
FIG. 1 is a partially cut-away perspective view of a flat panel image display device in accordance with the present invention.

With initial reference to FIG. 1, a flat panel image display device, generally designated as 10, comprises an envelope 12 including a front wall 18 and a rear wall 20, connected in spaced parallel relationship by sidewalls 22. The envelope 12 is divided into a display section 14 and an electron gun section 16. Within the display section 14 of the envelope 12 are a plurality of spaced parallel vanes 24 extending between the front and rear walls 18 and 20. The spaced vanes 24 divide the interior of the envelope 12 into a plurality of channels 26 and provide internal support for the envelope against atmospheric pressure. Within each of the channels 26 adjacent to the rear wall 20 are a plurality of electron beam guides 32 for directing electron beams from the gun section 16 along the length of the channel. On the interior surface of the front panel 18 is a cathodoluminescent screen 28 comprising a plurality of phosphor stripes 29 (FIG. 2) extending transversely across the channels 26 and the beam guides 32. The phosphor stripes 29 alternate between known phosphor materials which emit red, green, and blue light. A metal film anode 30 is provided on the phosphor screen 28.

The gun section 16 is an extension of the display section 14 and extends along one set of adjacent ends of the channels 26. The gun section 16 may be of any shape suitable to enclose the particular gun structure contained therein. The electron gun structure may be of any well known construction suitable for selectively directing beams of electrons along each of the channels 26. For example, the gun structure may comprise a plurality of individual guns mounted at the end of the channels 26. Alternately, the gun structure may include a line cathode extending along the gun section 16 across the ends of the channels 26 and adapted to selectively direct individual beams of electrons into the channels. A gun structure of the line type is described in U.S. Pat. No. 2,858,464, entitled "Cathode Ray Tube" issued on Oct. 28, 1958 to W. L. Roberts.

Figure 2:
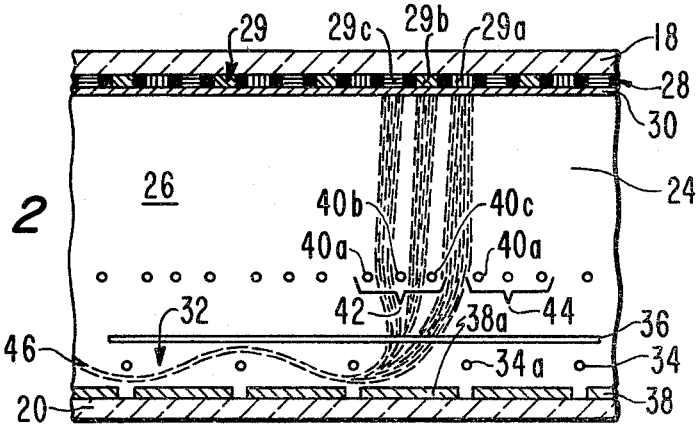
FIG. 2 is a sectional view of FIG. 1 taken along line 2—2.

Referring to FIG. 2, one type of electron beam guide 32 which may be used in the channels 26 is a slalom guide. The beam guides 32 extend in a longitudinal dimension which is orthogonal to the longitudinal dimension of the phosphor stripes 29 so that the phosphor stripes extend across several electron beam guides. The beam guides 32 include sets of first and second wires 34 and 36, respectively, and electrode stripes 38. The set of spaced parallel coplanar first wires 34 extends transversely across the channels 26. The first wires 34 being spaced 1.52 mm apart. The set of spaced parallel coplanar second wires 36 is between the first wires 34 and the screen 28 extending at right angles across the first wires 34 for the full length of the channels 26. The second wires 36 are spaced 1.52 mm. apart. The array of second wires 36 forms an electric grid. On the back wall 20 are a plurality of the electrode stripes 38 extending transversely across the channels 26. Each electrode stripe 38 is situated between adjacent pairs of first wires 34.

An array of substantially parallel coplanar focusing wires 40 is between the second wires 36 and the screen 28 extending transversely across the channel 26 parallel to the first wires 34. There are at least as many focus wires 40 as there are phosphor stripes 29. For a tri-color display, there are approximately three times as many focus wires 40 as first wires 34 with three wires 40*a–c* located between each pair of adjacent first wires 34. For optimum focusing of the electron beam, the focus wire spacing may vary. For example, the first focus wire 40*a* is spaced 0.25 mm along the longitudinal axis of the guide from the nearest first wire 34. The longitudinal spacing between the first focus wire 40*a* and the second focus wire 40*b* is about 0.46 mm while the second to third focus wire longitudinal spacing is 0.41 mm. The longitudinal distance between the third focus wire 40*c* of one triplet 42 and the first focus wire 40*a* of the next triplet 44 is approximately 0.65 mm.

During the operation of the device, the first wires 34 are biased to 400 volts. The electrode stripes 38 are at zero volts and the second wires 36 at 10 volts. The focus wires 40 are maintained at one of two voltage levels. Each of the first focus wires 40*a* is biased at 300 volts while the other two focus wires 40*b* and 40*c* are at 450 volts. The anode 30 may typically be at 7500 volts. A voltage supply 15 (FIG. 1) biases the various electrodes.

A plurality of electron beams 46 are simultaneously generated in the gun section 16 and directed between the electrode stripes 38 and the second wires 36 of each guide 32. Because of the relative high positive potential on the first wires 34 as compared to the potential of the second wires 36 and the electrode stripes 38, the electron beam travels in an undulating path above and below the first wires 34. The potential on the second wires 36 not only produces the undulation of the beam 46, but also confines the electrons into a beam, preventing them from spreading out normal to the plane of FIG. 2.

The beams 46 continue traveling in the guide 32 until they are deflected toward the screen 28. The deflection is accomplished by reducing the bias voltage on one of the first wires 34*a*. The reduction in voltage causes the beam 46 to exit the guide between a pair of second wires 36. The beams 46 are extracted simultaneously from each guide 32 to display an entire line of the image on the screen 28. The line on the screen is actually composed of three different colored phosphor stripes 29*a–c*. One third of the conventional NTSC line scan time is devoted to the excitation of each of the three phosphor stripes 29*a–c*. During the first third of the line scan time, the extraction voltage on the first wire 34*a* is about 25V negative. The beam 46 is directed out of each guide 32 and between the third focus wire 40*c* of the wire triplet 42 opposite the position of the electrode stripe 38*a* and the first focus wire 40*a* of the next focus triplet 44. The potentiais on the focus wire 40*c* and 40*a* straighten the beam out as it passes between the wires and focus the beam onto the first phosphor stripe 29*a*. During the second third of the line scan time, the voltage on the one first wire 34*a* is changed to −115 volts. The negative voltage bends the beam 46 more sharply directing it between the second and third focus electrodes 40*b* and 40*c*, respectively. The beam 46 is straightened out and focused onto the second phosphor stripe 29*b*. During the final third of the line scan time, the potential on the one first wire 38*a* changes to −275 volts which bends the beam 46 between the first and second focus wires 40*a* and 40*b*. The potentials on these two focus wires 40*a* and 40*b* straighten and focus the beam onto the third phosphor stripe 29*c* to display the final color of the display line. As an alternative the potentials on the first wires 34 may be held constant and the potential on one of the electrode stripes 38*a* changed to repel the beams 46 from the guides 32. Conventional circuitry can be employed to store and delay the video signal for each color until that color information is to be displayed. For example, each color signal may be digitized and stored in a shift register until used to modulate the beams.

Although as previously mentioned, deflecting the beam out of the guides to various screen positions has been proposed for line interlace purposes, such simple deflection at each extraction point of the guide cannot effectively be used for color selection due to the divergence of the beam. In the color device 10, the width of the display line is divided into three separate color stripes 29. Once the beam 46 has been extracted from the guide 32, it must be restricted from spreading out and be focused onto only one phosphor stripe. Excessive spreading adversely affects line resolution and color purity. The different extraction voltages on the first wires 34 or the back electrodes 38 direct the beam 46 between the proper pair of focus electrodes 40. As the beam 48 passes between the electrodes 40, it is straightened out and focused onto the corresponding stripe 29.

Figure 3:
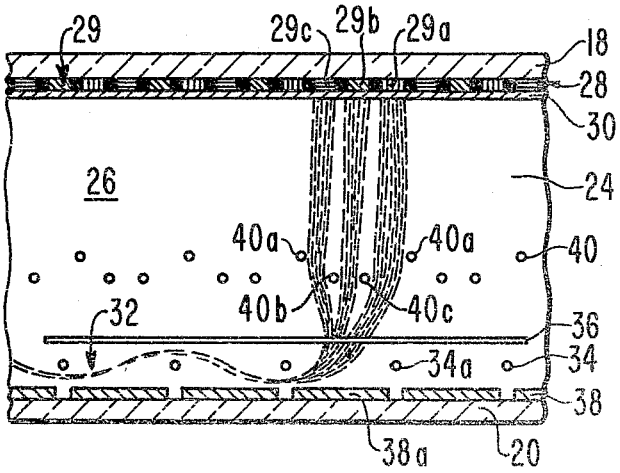
FIG. 3 is a view similar to FIG. 2 showing a different embodiment of the present invention.

Another embodiment of the present invention employs a non-planar array of focus wires 40 as shown in FIG. 3. The first focus wire 40*a* is closer to the screen 28 by about 0.15 mm than the second and third wires 40*b* and 40*c* which are coplanar. The longitudinal spacings are the same as in the embodiment in FIG. 2. In this case, all of the focus wires 40 are biased to the same potential and the physical position of each wire establishes the proper electric fields to straighten out and focus the beam.

What is claimed is:

1. A color image display device comprising:

an evacuated envelope having front and back walls in a spaced, substantially parallel relationship;

a cathodoluminescent screen on the front wall, the screen comprising a plurality of alternating stripes of different color light emitting phosphor materials;

an array of focus wires in a longitudinally spaced, substantially parallel relationship within the envelope substantially parallel to the screen, the spacing between mutually adjacent focus wires within the array being unequal, there being at least as many wires in the array as the number of phosphor stripes, a source of electrons for the display device; and a plurality of electron beam guides extending across the screen between the array of focus wires and the back wall for confining electrons from the source into a beam, said guides including means for extracting the beams out of the guides at various points and directing the beams at each extraction point between different pairs of focus wires in the array and onto the corresponding stripes on the screen.

2. The device as in claim 1 wherein the phosphor stripes and the focus wires in the array extend longitudinally in the same dimension.

3. The device as in claim 2 wherein the beam guides extend orthogonally across the phosphor stripes.

4. The device as in claim 2 wherein the array of focus wires is planar.

5. The device as in claim 4 wherein the wires in the array are biased at different constant potentials.

6. The device as in claim 2 wherein the array of focus wires is nonplanar.

7. The device as in claim 6 wherein the wires in the array are biased at the same constant potential.

8. The device as in claim 1 including means for biasing the focus wires in the array.

9. The device as in claim 1 wherein the electron beam guides comprise:

at least one electrode on the back wall of the envelope;

a plurality of coplanar first wires parallel to the screen between the back wall and the array extending longitudinally in the same dimension as the phosphor stripes; and a grid structure between the first wires and the array.

10. The device as in claim 9 wherein the first wires extend longitudinally in the same dimension as the focus wires as there are approximately three times as many focus wires as there are first wires.

* * * * *